US012698058B2

(12) United States Patent
Strong

(10) Patent No.: US 12,698,058 B2
(45) Date of Patent: Aug. 4, 2026

(54) SEABED CONNECTION HUB

(71) Applicant: REFLEX MARINE LTD, Bristol (GB)

(72) Inventor: Philip Strong, Bristol (GB)

(73) Assignee: REFLEX MARINE LTD, Bristol (GB)

( * ) Notice: Subject to any disclaimer, the term of this patent is extended or adjusted under 35 U.S.C. 154(b) by 86 days.

(21) Appl. No.: 18/698,366

(22) PCT Filed: Oct. 17, 2022

(86) PCT No.: PCT/GB2022/052633
§ 371 (c)(1),
(2) Date: Apr. 4, 2024

(87) PCT Pub. No.: WO2023/073345
PCT Pub. Date: May 4, 2023

(65) Prior Publication Data

US 2025/0236360 A1 Jul. 24, 2025

(30) Foreign Application Priority Data

Oct. 29, 2021 (GB) ..... 2115610

(51) Int. Cl.
*E02D 5/80* (2006.01)
*B63B 21/50* (2006.01)

(52) U.S. Cl.
CPC ..... *B63B 21/50* (2013.01); *B63B 2021/505* (2013.01)

(58) Field of Classification Search
CPC ... B63B 21/50; B63B 2021/505; B63B 21/26; E02D 27/52
See application file for complete search history.

(56) References Cited

U.S. PATENT DOCUMENTS 3,670,686 A * 6/1972 Reynolds ..... B63B 22/023 114/294
5,515,656 A * 5/1996 Mihalich ..... B64F 1/12 248/156

(Continued)

FOREIGN PATENT DOCUMENTS

| | | | |
|---|---|---|---|
| GB | 1589839 | A | 5/1981 |
| WO | 2020206499 | A1 | 10/2020 |
| WO | 2021002607 | A1 | 1/2021 |

*Primary Examiner* — Carib A Oquendo
(74) *Attorney, Agent, or Firm* — Jose Cherson Weissbrot

(57) ABSTRACT

The present invention provides a seabed connection hub (SCH) for guiding a drilling assembly to drill a bore hole and subsequently guiding a deep set tensile anchor into the bore hole. The seabed connection hub (SCH) comprising a body member configured to act as a sea bed anchor. The body member comprises a lower surface configured in use to rest upon, and for at least a portion of the lower surface of the body member to penetrate the sea bed. The body member comprises a guide channel extending therethrough to a first opening provided in the lower surface of the body member. The guide channel is configured to receive and guide a drilling assembly to produce a bore hole. The guide channel is configured to receive and guide a deep set tensile anchor therethrough into the opening of the bore hole. The body member further comprises at least one connector for engaging one or more mooring line termination for an offshore installation. The lower surface of the body member is profiled to extend at an angle to a reference plane defined by the sea bed adjacent the bore hole.

15 Claims, 15 Drawing Sheets

(56) References Cited

U.S. PATENT DOCUMENTS

| | | | | |
|---|---|---|---|---|
| 2003/0077127 | A1* | 4/2003 | Jones | E02D 13/04 405/253 |
| 2009/0038525 | A1* | 2/2009 | De Medeiros Junior | B63B 21/29 114/294 |
| 2009/0123235 | A1* | 5/2009 | Maconochie | B63B 21/27 405/227 |
| 2011/0293379 | A1* | 12/2011 | Halkyard | E02B 17/0008 405/224 |
| 2023/0024467 | A1* | 1/2023 | Fernandez Ibañez | E02D 5/80 |
| 2023/0182876 | A1* | 6/2023 | Eldred | B63G 8/14 114/294 |
| 2023/0392337 | A1* | 12/2023 | Hassavari | E02D 27/525 |

* cited by examiner

SEABED CONNECTION HUB

The present invention relates to a seabed connection hub (SCH) configured to act as an upper section of a deep set tensile anchor. The seabed connection hub (SCH) serves as a resistance point accommodating the change in direction of the tensile loading from vertical to lateral whilst also providing a connector for mooring line termination for offshore installations. The present invention also relates to the method of enhancing the functionality of a deep set tensile anchor by using the seabed connection hub (SCH).

BACKGROUND OF INVENTION

A variety of pile guide systems are known in the art, for use with driven piles and suction piles. However, such systems have however been found to suffer from several disadvantages.

It is among the objectives of embodiments of the present invention to obviate or alleviate these and other disadvantages of known pile guide systems by providing a seabed connection hub (SCH) which may act as a seabed termination for a deep set anchor and providing connectors for mooring lines of offshore installations.

SUMMARY OF INVENTION

According to a first aspect of the present invention, there is provided a seabed connection hub (SCH) for guiding a drilling assembly to drill a bore hole and subsequently guiding a deep set tensile anchor into the bore hole, the seabed connection hub (SCH) comprising a body member configured to act as an upper section of a deep set tensile anchor, in which the body member comprises a lower surface configured in use to rest upon, and for at least a portion of the lower surface of the body member to penetrate, the sea bed, in which the body member comprises:

- a guide channel extending therethrough to a first opening provided in the lower surface of the body member, in which the guide channel is configured to receive and guide a drilling assembly for drilling a bore hole, and in which the guide channel is configured to receive and guide a deep set tensile anchor therethrough and into the bore hole; and
- at least one connector for engaging one or more mooring line termination for an offshore installation.

The lower surface of the body member, once embedded into the sea bed, may provide resistance to the lateral vector force from the one or more mooring line terminations.

The body member may be composed of concrete.

The lower surface of the body member preferably comprises a tapered or conical portion.

The shape and/or dimensions of the body member may be varied with a view to optimising the bending stresses and the transfer of the lateral component of mooring lines loads into the soil adjacent the body member and bore hole. For example, the lower surface of the body member is preferably profiled to extend at an angle to a reference plane defined by the sea bed adjacent the bore hole.

In one embodiment, the body member comprises an upper surface defining a second opening for receiving a deep set tensile anchor therethrough. The guide channel preferably extends between the first and second openings of the body member.

The first and second openings are preferably axially aligned along an axis which in use is configured to extend substantially parallel to the longitudinal axis of the bore hole.

In one embodiment, the second opening has greater dimensions than the first opening.

The body member preferably further comprises a hollow tubular portion positioned adjacent and in communication with the first opening provided on the lower surface thereof. The hollow tubular portion preferably extends outwardly from the lower surface of the body portion to define a portion of the guide channel extending through the hollow tubular portion.

The hollow tubular portion may extend at any angle relative to the lower surface of the body portion. Preferably, the hollow tubular portion defines a portion of the guide channel having a longitudinal axis which extends substantially perpendicular to a reference plane defined by the sea bed.

The lower surface of the body member may be profiled to extend at an angle to the longitudinal axis of the hollow tubular portion.

The hollow tubular portion preferably defines a portion of the guide channel having a longitudinal axis which is configured to extend, in use, substantially parallel to the longitudinal axis of the bore hole.

The hollow tubular portion is preferably composed of steel.

The hollow tubular portion may have a sharpened profile to facilitate penetration of the substrate.

The hollow tubular portion may be releasably engageable to the lower surface of the body member. The base may comprise a plurality of hollow tubular portions having different shapes and/or dimensions depending on the requirements for installation into a bore hole.

The hollow tubular portion preferably comprises a first end located, in use, adjacent the lower surface of the body member and an opposed second end. The hollow tubular portion preferably comprises a tapered or conical portion at or adjacent the first end thereof, for example adjacent the lower surface of the body member. The tapered or conical portion may extend outwardly in a direction extending towards the first end of the hollow tubular portion. The hollow tubular portion preferably comprises a cylindrical portion at or adjacent the second end thereof. The hollow tubular portion may comprise an inwardly tapering or conical portion at or adjacent the second end thereof. The inwardly tapering or conical portion may taper inwardly in a direction extending towards the second end thereof.

The hollow tubular portion is configured to be driven into the sea bed to provide an upper section of the bore hole (i.e. adjacent the opening of the bore hole). The hollow tubular portion is configured to provide support to the upper section of the bore hole, i.e. to prevent collapse of the surrounding soil into the bore hole, prior to and during subsequent drilling of the bore hole. The hollow tubular portion therefore helps to stabilise the soil, for example soft soil structures, adjacent the upper section of the bore hole.

The seabed connection hub (SCH) may further comprise at least one connector for engaging one or more mooring line terminations for offshore installations.

The at least one connector is preferably configured for releasable engagement to one or more mooring line termination for offshore installations. The one or more mooring line terminations for an offshore installation may be released from the connector(s) and the seabed connection hub (SCH) may be reused for connection to further mooring line terminations.

The at least one connector may be of fixed orientation relative to the base member. Alternatively, the at least one connector may be a hinged or pivotally connected connector.

The at least one connector may be provided at a predetermined angle for engagement to a mooring line termination, preferably for example to provide connection extending substantially parallel to the longitudinal axis of the bore hole.

The at least one connector may be pivotable or hingeably connected to the base member such that the at least one connector may be adjustable, for example pivotable, to align with an axis defined by for example the mooring line (such as for example in a taut mooring configuration).

Preferably, the at least one connector is spaced apart from the lower surface of the base member. For example, the at least one connector may be located at or adjacent an upper surface of the base member. The connector(s) may be located on the base member at a location which in use is positioned at a height about the sea bed to prevent the engaged mooring line from interacting with the seabed soils. This arrangement therefore reduces the risk of damage to the mooring line during engagement with the base member whilst also improving the efficiency of connection of the mooring line.

The base member may comprise a first side (extending between the upper and lower surfaces thereof), in which at least portion of the first side is configured in use to face towards the mooring line of the off shore installation during use. The at least one connector is preferably located at or adjacent the first side portion of the base member.

The seabed connection hub (SCH) may further comprise at least one resistance member extending outwardly from the body member and configured such that a portion of the at least one resistance member is received within the sea bed. The at least one resistance member is preferably configured to be received within the soil to increase resistance once embedded in the soil.

The at least one resistance member may for example be a plate member. The plate member may comprise one or more angled sections to improve resistance.

The resistance member preferably comprises an upper end positioned towards or adjacent an upper end of the base member, and an opposed lower end which is angular in shape to aid penetration into the sea bed.

The resistance member is preferably composed of steel.

The resistance member preferably extends from the lower surface towards the upper surface of the base member. The lower end of the resistance member preferably extends beyond the lower surface of the base member such that the lower end is embedded into the sea bed during installation.

At least a portion of, for example substantially all of, the body of the resistance member may define a plane extending substantially parallel to the longitudinal axis defined by the bore hole. In one embodiment, at least a portion of the body of the resistance member may define a plane extending at an angle to the longitudinal axis defined by the bore hole.

In one embodiment, the or each resistance member comprises a first body portion defining and extending from the lower end thereof. The first body portion preferably defines a plane extending substantially parallel to the longitudinal axis defined by the bore hole to increase penetration of the or each resistance member into the seabed during use. The or each resistance member may further comprise a second body portion located adjacent or extending from the first body portion. The second body portion preferably defines a plane extending at an angle to the first body portion and to the longitudinal axis defined by the bore hole. In one embodiment, the second body portion preferably defines a plane extending substantially perpendicular to the angle defined by the at least one connector for engaging a mooring line termination. The second body portion therefore provides increased resistance to the vector forces transmitted from the mooring line termination in use.

In one embodiment, the body member preferably comprises at least one connector located on a first end thereof for engaging one or more mooring line termination for offshore installations, and in which the body member further comprises at least one resistance member located at or adjacent a second opposed end of the body member. The body member may further comprise side portions extending between the first and second ends of the body member. In one embodiment, one or more resistance members may be located on one or more, preferably each, of the side portions. In one embodiment, the body member may comprise at least one resistance member located at a first end of the body member. In one embodiment, the at least one connector is configured to extend through at least one resistance member.

The elongate tensile member may be one or more of: pipe, wire rope and/or chain.

The seabed connection hub (SCH) preferably further comprises a locking and tensioning mechanism located within the guide channel to engage a elongate tensile member attached to an upper end of the deep set anchor. The locking and tensioning mechanism may be located at any suitable location within the guide channel. For example, the locking and tensioning mechanism may be located substantially centrally between the first and second openings, for example between the upper and lower surfaces of the base member.

The locking and tensioning mechanism may comprise a gripping device for engaging a elongate tensile member connected to the deep set anchor. The locking and tensioning mechanism may comprise one or more securement features, spaced apart from the gripping device, for securing (for example attaching and/or abutting) a portion of the locking and tensioning mechanism in position within the guide channel of the body member. The locking and tensioning mechanism may further comprise a linear actuator, for example a hydraulic actuator, for adjusting the distance, in use, between the gripping device and the securement features.

The gripping device may for example comprise a plurality of circumferentially spaced apart, gripping portions, for example in an annular array.

In use, the locking and tensioning mechanism is configured such that the gripping device engages a portion of the elongate tensile member. The linear actuator transmits a vertical, downward force (in a direction aligned with the axis of the guide channel and/or longitudinal axis of the bore hole) causing the securement features to move the body member in a downward direction towards the bore hole, causing the body member to be more securely embedded within the seabed.

According to a second aspect of the present invention, there is provided a method of installing a deep set anchor using an seabed connection hub (SCH) as herein described, the method comprising:

- positioning an seabed connection hub (SCH) as herein described such that the lower surface of the body member rests upon, and at least a portion of the lower surface of the body member penetrates, the sea bed;
- guiding a drilling assembly through the guide channel and first opening of the body member to be aligned with a predetermined location for providing a bore hole;
- operating the drilling assembly to drill the bore hole;

inserting a deep set tensile anchor on a elongate tensile member through the guide channel and first opening of the body member into the bore hole;

optionally operating a locking and tensioning mechanism located within the guide channel to engage the elongate tensile member attached to the deep set tensile anchor; and connecting one or more mooring line to the at least one connector, and subsequently tensioning to the one or more mooring line.

Embodiments of the present invention will now be described in further detail with reference to the accompanying Figures:

DETAILED DESCRIPTION

Figure 1:
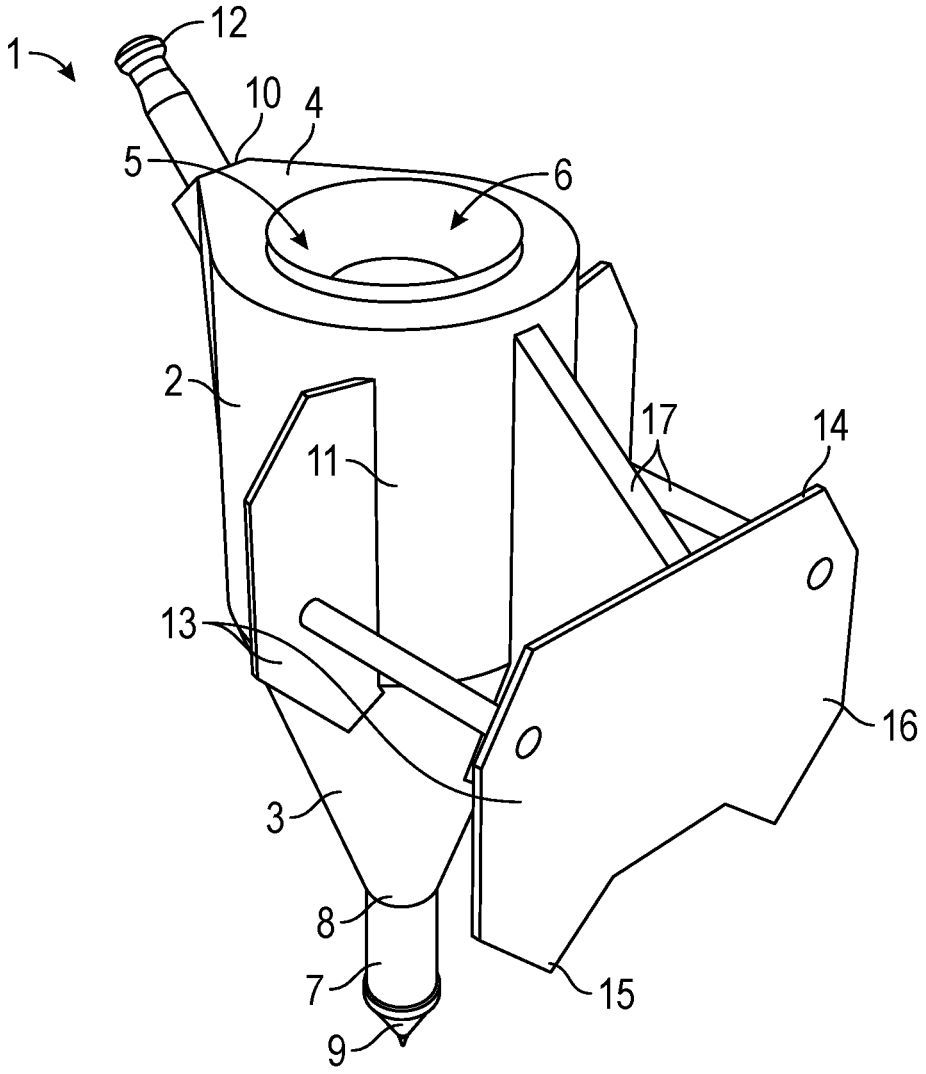
FIG. 1 is a schematic illustration of a perspective rear view from above of the seabed connection hub (SCH) according to one embodiment of the present invention.
Figure 2:
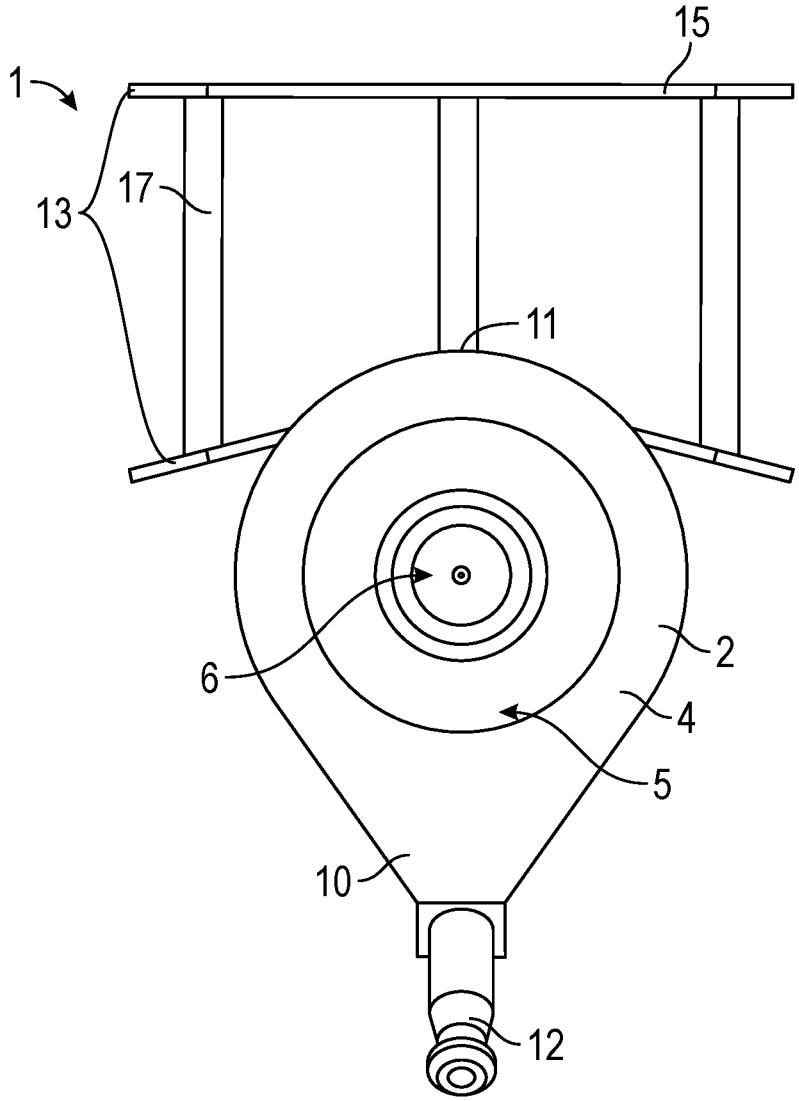
FIG. 2 is a schematic illustration from above of the seabed connection hub (SCH) of FIG. 1.
Figure 3:
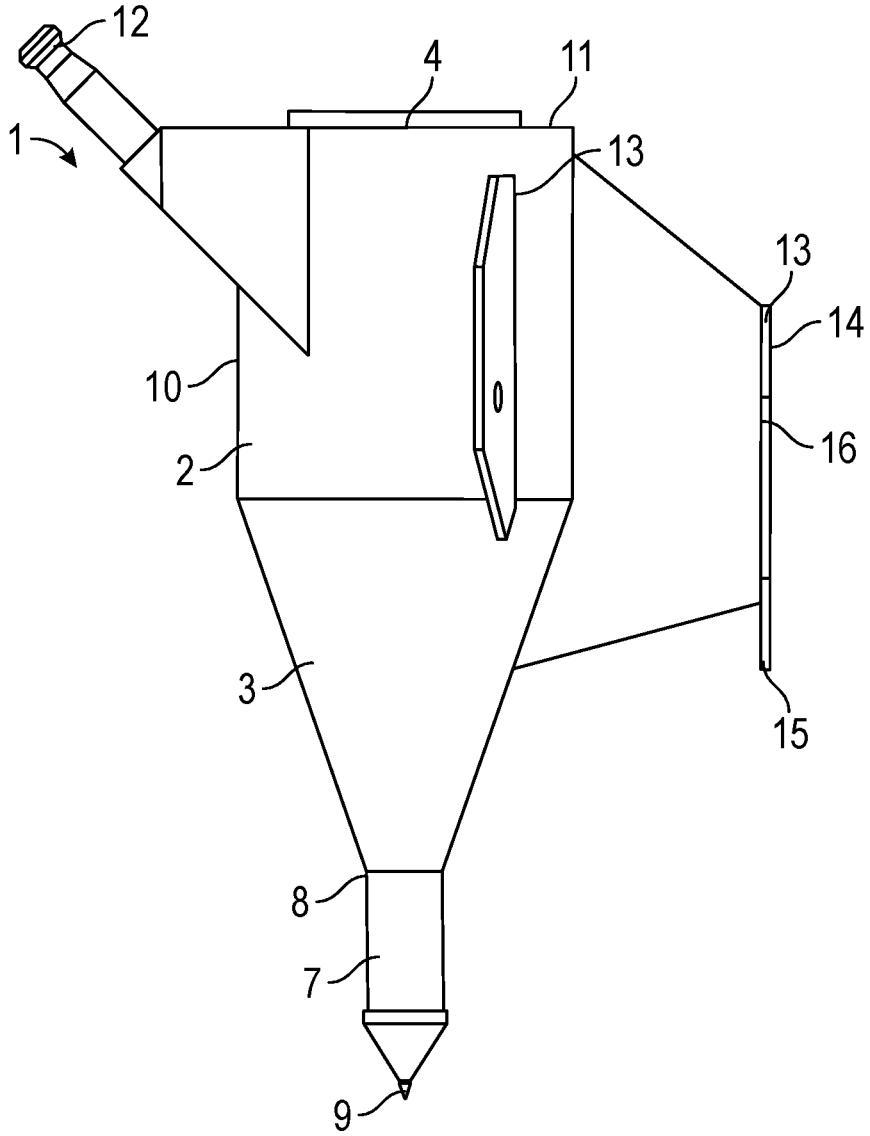
FIG. 3 is a schematic illustration of a side view of the seabed connection hub (SCH) of FIG. 1.
Figure 4:
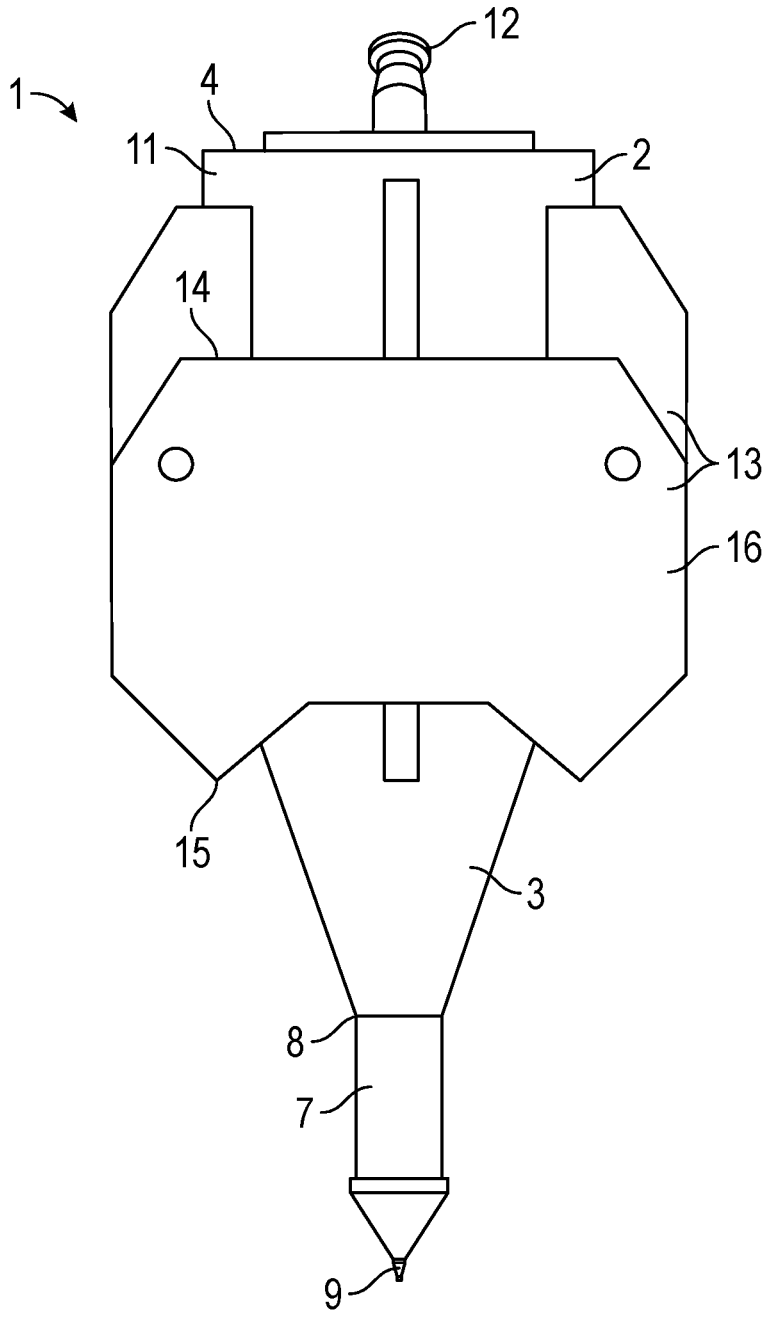
FIG. 4 is a schematic illustration of a rear view of the seabed connection hub (SCH) of FIG. 1.
Figure 5:
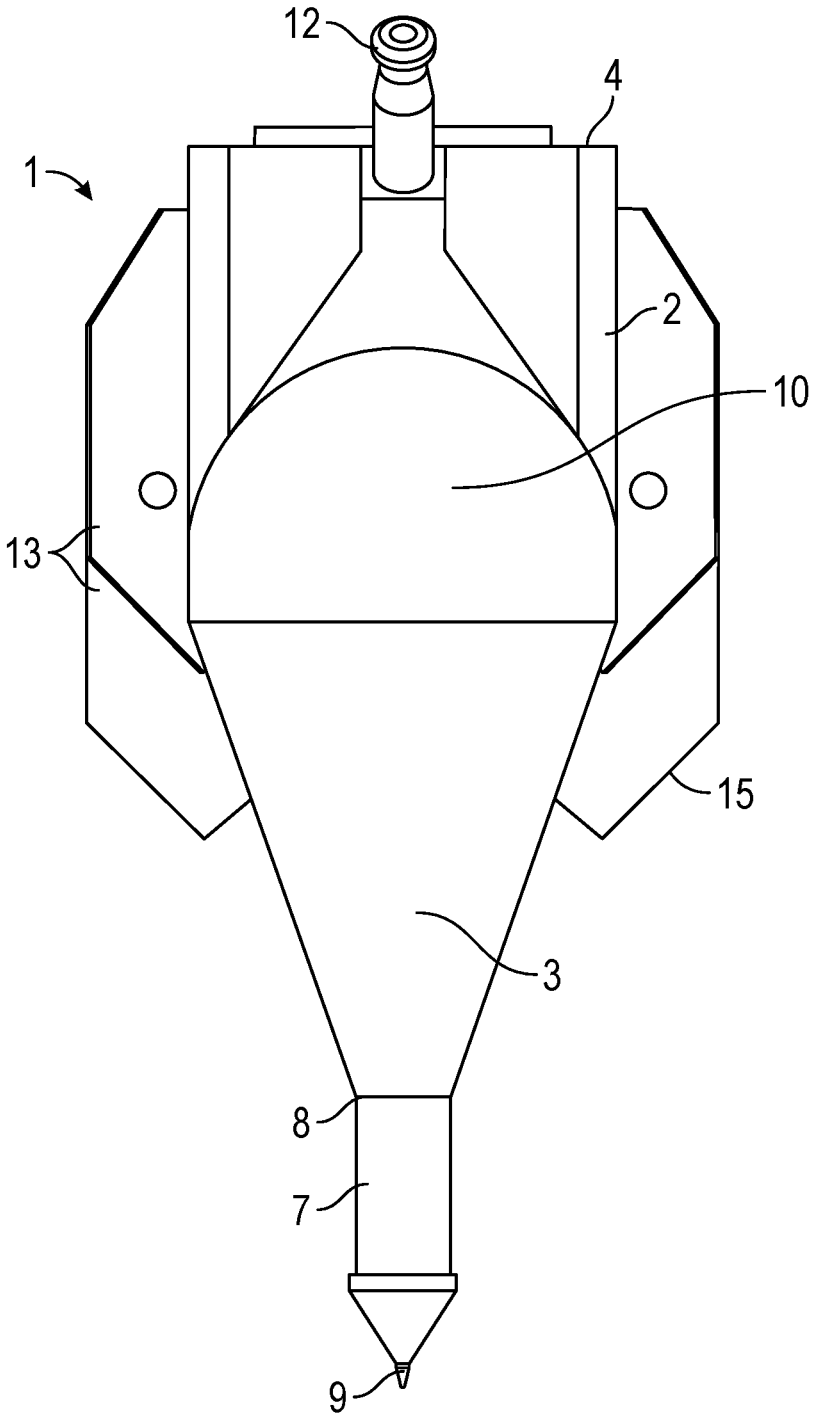
FIG. 5 is a schematic illustration of a front view of front seabed connection hub (SCH) of FIG. 1.
Figure 6:
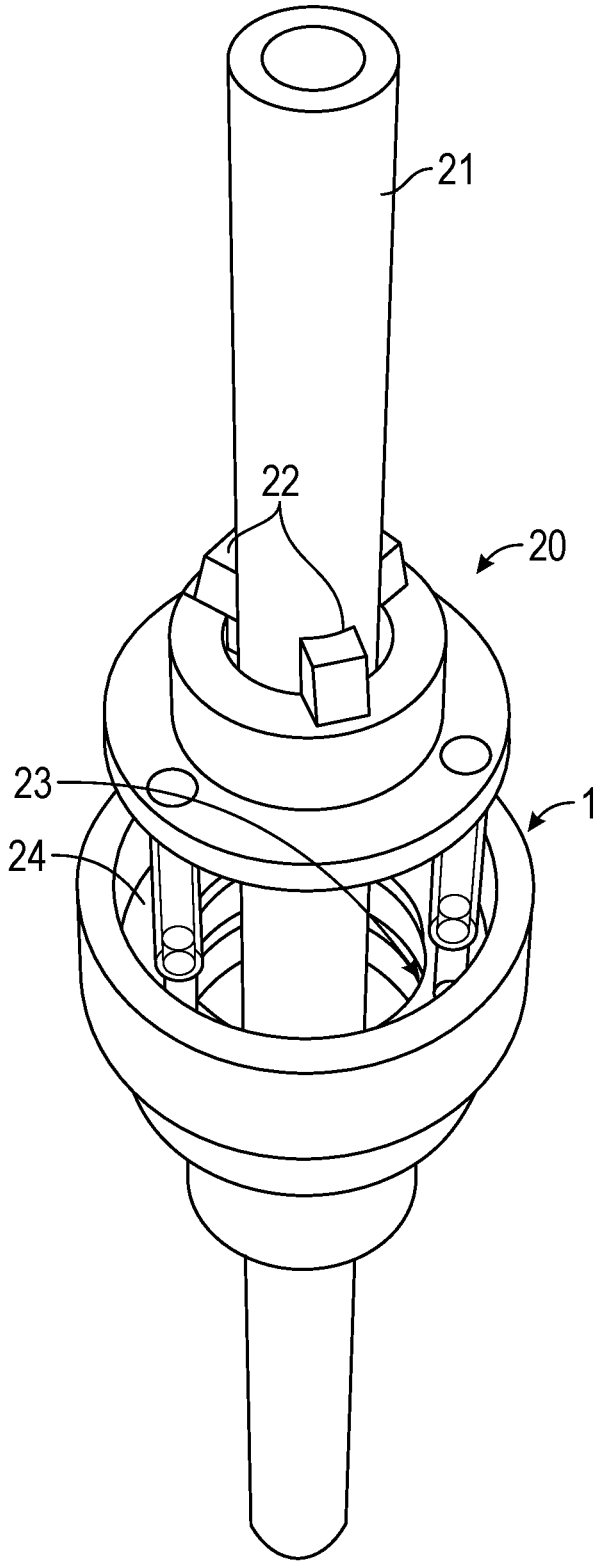
FIG. 6 is a schematic illustration of a perspective view from above of the locking and tensioning mechanism of the seabed connection hub according to one embodiment of the present invention in position on a elongate tensile member of a deep set tensile anchor.
Figure 7A:
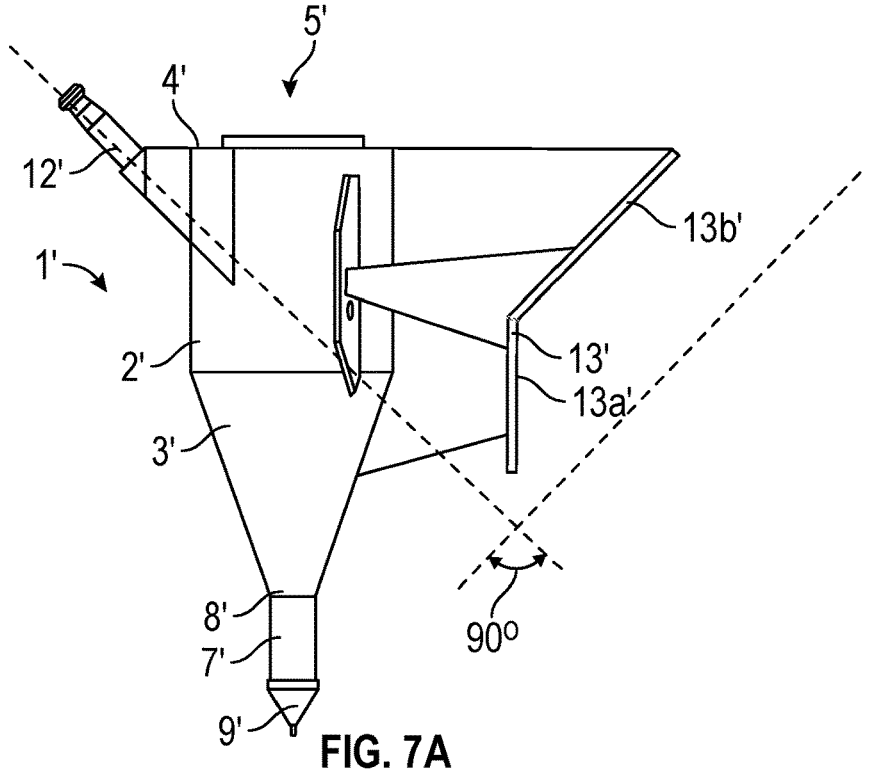
FIGS. 7A and 7B are schematic illustrations of a side view and a view from above of the seabed connection hub (SCH) according to one embodiment of the present invention.
Figure 7B:
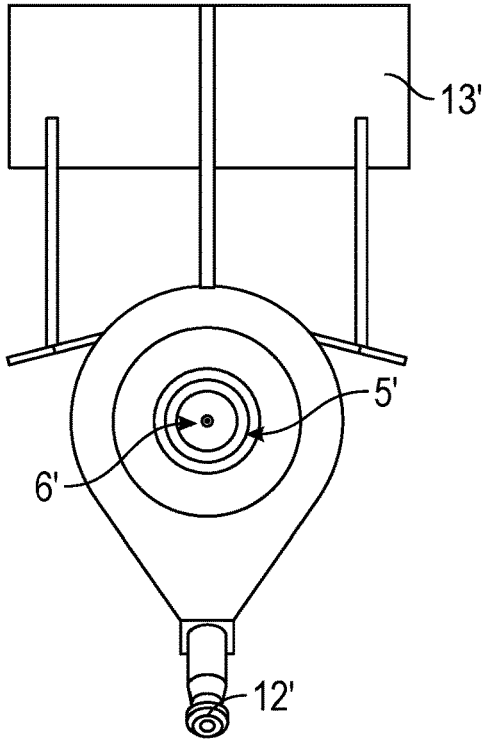
Figure 8:
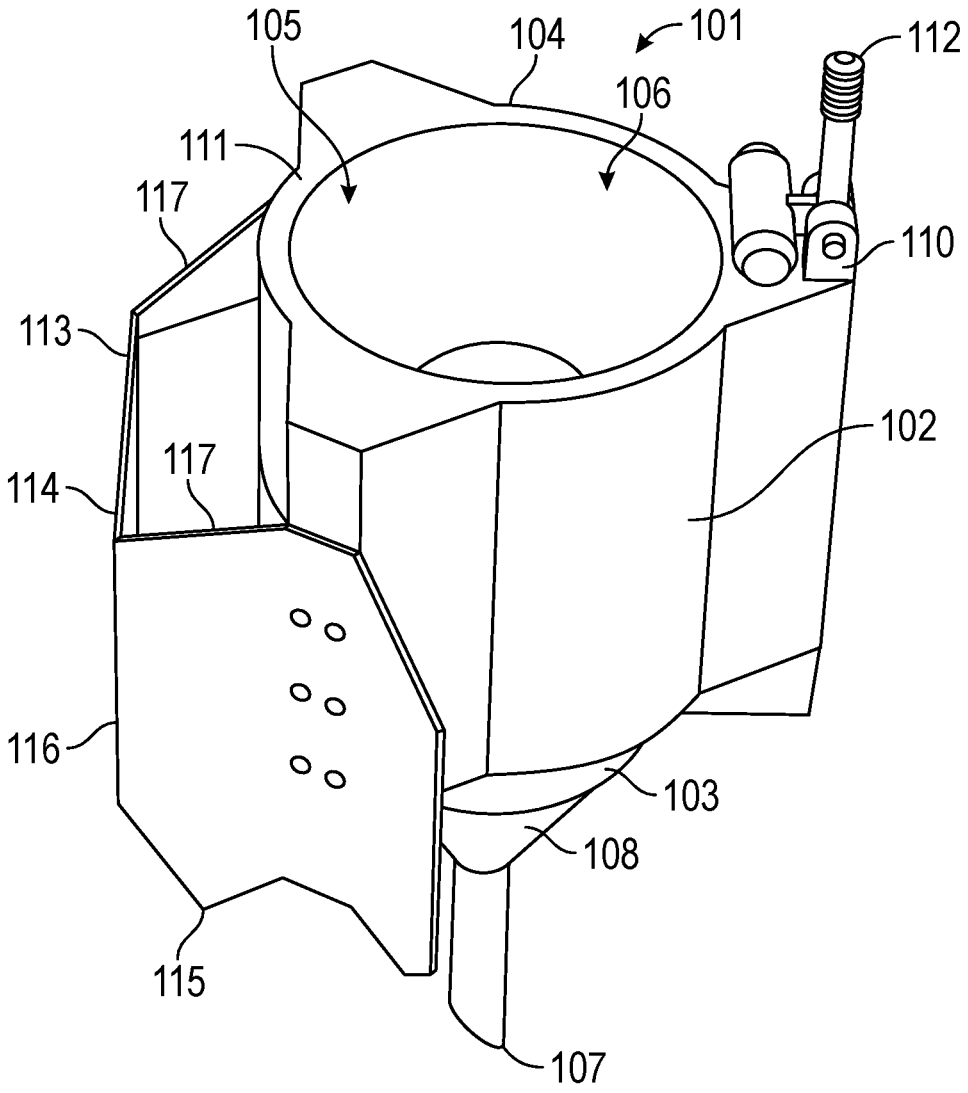
FIG. 8 is a schematic illustration of a perspective view from above of the seabed connection hub (SCH) according to a further embodiment of the present invention.
Figure 9:
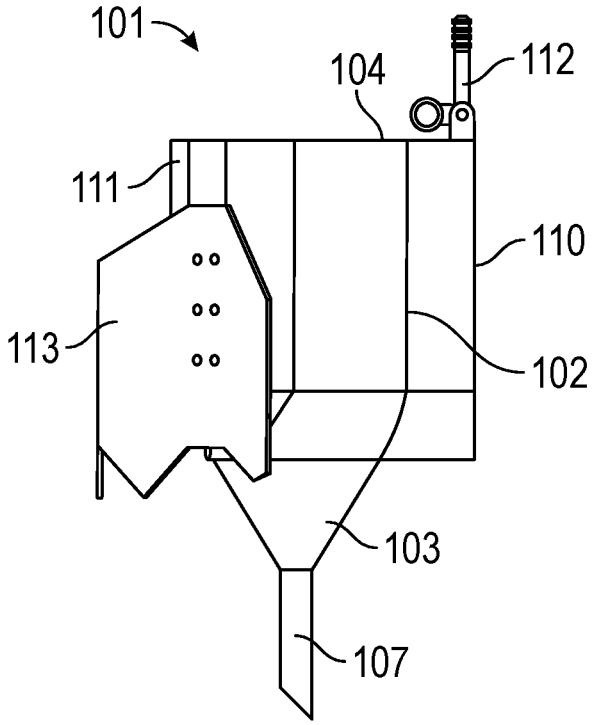
FIG. 9 is a schematic illustration of a side view of the seabed connection hub (SCH) of FIG. 8.
Figure 10:
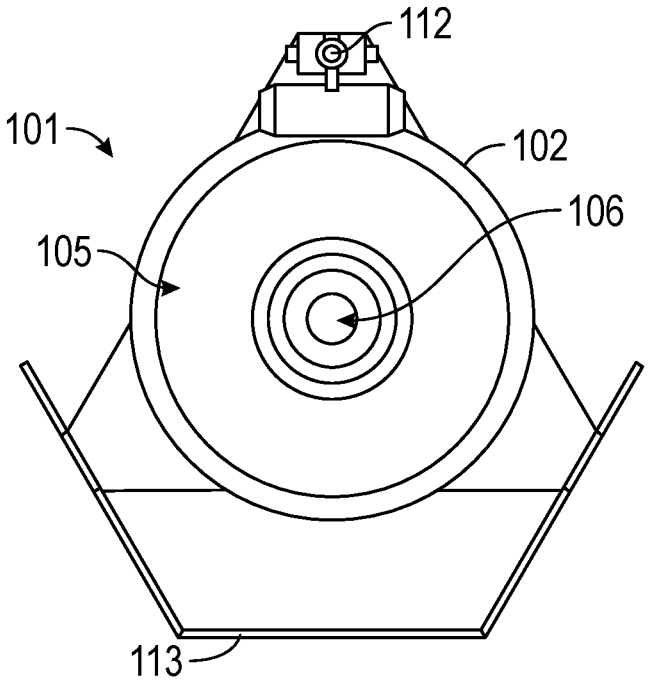
FIG. 10 is a schematic illustration of a view from above of the seabed connection hub (SCH) of FIG. 8.
Figure 11:
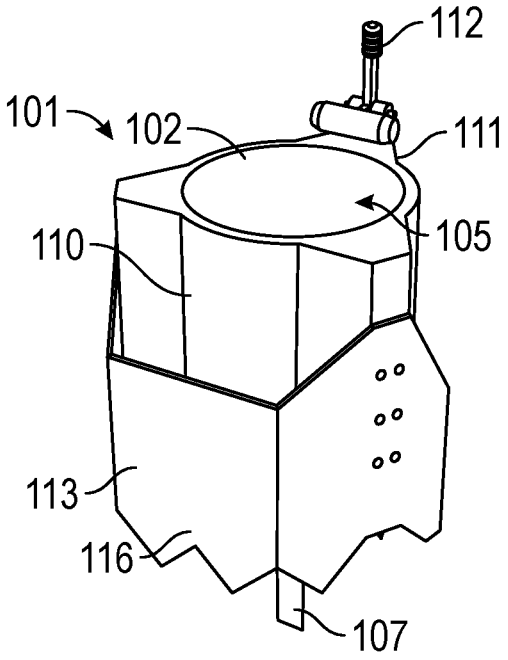
FIG. 11 is schematic illustration of a perspective rear view of the seabed connection hub (SCH) of FIG. 8.
Figure 12:
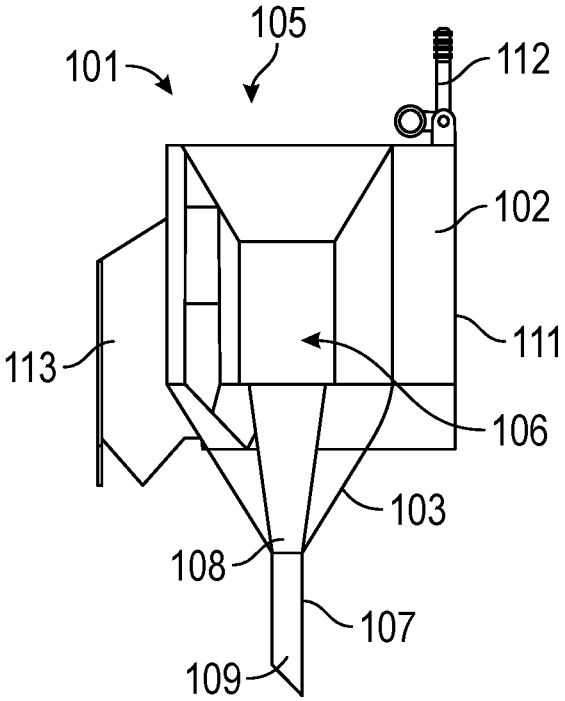
FIG. 12 is a schematic illustration of a cross-sectional side view of the seabed connection hub (SCH) of FIG. 8.
Figure 13:
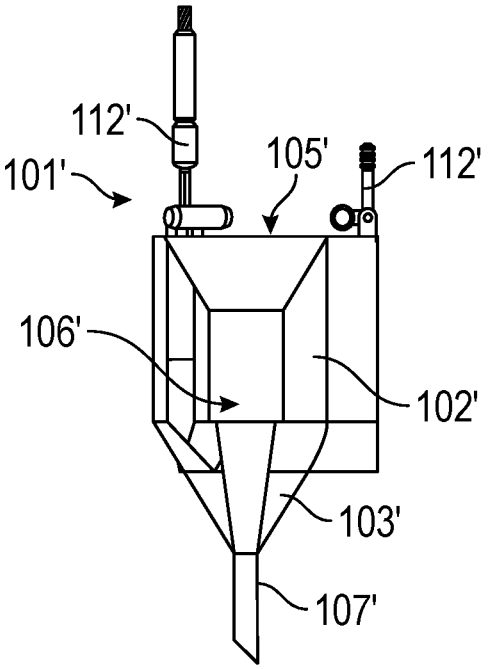
FIG. 13 is a schematic illustration of a cross-sectional side view of a seabed connection hub (SCH) according to a further embodiment of the present invention, in which the hub comprises three connectors.

With reference to the Figures, the seabed connection hub (SCH) 1, 1', 101, 101' comprises a body member 2, 2', 102, 102' composed of concrete, or other suitably dense material, configured to act as a sea bed anchor. The body member 2, 2', 102, 102' comprises a lower surface 3, 3', 103, 103' configured in use to rest upon, and for at least a portion of the lower surface 3, 103, 103' of the body member 2, 2', 102, 102' to penetrate, the sea bed. The lower surface 3, 3', 103, 103' of the body member 2, 2', 102, 102' provides a first opening (not shown). The body member 2, 2', 102, 102' further comprises an opposed upper surface 4, 4', 104, 104' defining a second opening 5, 5', 105, 105'. The second opening 5, 5', 105, 105' has greater dimensions than the first opening (not shown). It is however to be understood that the first (not shown) and second openings 5, 5', 105, 105' may have the same dimensions. A guide channel 6, 6', 106, 106' for receiving a deep set anchor therethrough, extends between the first (not shown) and second openings 5, 5', 105, 105' of the body member 2, 2', 102, 102'. The guide channel 6, 6', 106, 106' may taper inwardly between the first (not shown) and second openings 5, 5', 105, 105' of the body member 2, 2', 102, 102'.

It is to be appreciated that although the guide channel 6, 6', 106, 106' in the illustrated embodiments extends between the upper and lower surfaces 3, 3', 103, 103', 4, 4', 104, 104' of the body member 2, 2', 102, 102' that the guide channel 6, 6', 106, 106' may extend between any suitable surface and the lower surface 3, 3', 103, 103' of the body member 2, 2', 102, 102'.

In the illustrated embodiment, the first (not shown) and second openings 5, 5', 105, 105' are axially aligned such that the guide channel 6, 6', 106, 106' extending therebetween is substantially linear in shape. It is however to be understood that the guide channel 6, 6', 106, 10' may have any suitable configuration depending on the requirements for the seabed connection hub (SCH), for example the guide channel 6, 6', 106, 106' may comprise one or more curved portions and/or one or more diverging portions.

The lower surface 3, 3', 103, 103' of the body member 2, 2', 102, 102' once embedded into the sea bed, may provide resistance to the lateral vector force from the one or more mooring line terminations. In the illustrated embodiment, the lower surface 3, 3', 103, 103' of the base member 2, 2', 102, 102' is substantially conical in shape. The conical lower surface 3, 3', 103, 103' tapers inwardly in a direction extending away from the base member 2, 2', 102, 102' and towards the bore hole. It is however to be understood that the lower surface 3, 3', 103, 103' may have any suitable profile for providing resistance to the lateral vector force. For example, the lower surface 3, 3', 103, 103' may be substantially planar and/or may extend at an angle to a reference plane defined relative to the plane defined by the sea bed adjacent the bore hole.

The seabed connection hub serves in use as a resistance point accommodating the change in direction of the tensile loading from vertical to lateral. The shape and/or dimensions of the body member 2, 2', 102, 102' may be varied with a view to optimising the bending stresses and the transfer of the lateral component of mooring lines loads into the soil adjacent the body member 2, 2' 102, 102' and bore hole.

The body member 2, 2', 102, 102' further comprises a hollow tubular portion 7, 7', 107, 107' composed of steel, positioned adjacent and in communication with the first opening (not shown) provided on the lower surface 3, 3 #, 103, 103' thereof. The hollow tubular portion 7, 7', 107, 107' extends outwardly from the lower surface 3, 3', 103, 103' of the body portion 2, 2', 102, 102' and a portion of the guide channel 6, 6', 106, 106' extends through the hollow tubular portion 7, 7', 107, 107'.

In the illustrated embodiments, the hollow tubular portion 7, 7', 107, 107' defines a portion of the guide channel 6, 6', 106, 106' having a longitudinal axis which extends substantially perpendicular to a reference plane defined by the sea bed. The hollow tubular portion 7, 7', 107, 107' defines a portion of the guide channel 6, 6', 106, 106' having a longitudinal axis which is configured to extend, in use, substantially parallel to the longitudinal axis of the bore hole.

In the illustrated embodiments, the hollow tubular portion 7, 7', 107, 107' forms an integral component of the seabed connection hub (SCH) 1, 1', 101, 101'. It is however to be understood that the hollow tubular portion 7, 7', 107, 107' may be releasably engaged to the lower surface 3, 3', 103, 103' of the body member 2, 2', 102, 102'. The hub 1, 1', 101, 101' may comprise a plurality of hollow tubular portions 7, 7', 107, 107' having different shapes and/or dimensions which may be selected depending on the requirements for installation into a bore hole.

The hollow tubular portion 7, 7', 107, 107' comprises a first end 8, 108, 108' located adjacent the lower surface 3, 103, 103' of the body member 2, 102, 102' and an opposed, tapered second end 9, 109, 109'. The hollow tubular portion 7, 107, 107' is substantially cylindrical in shape with a tapered second end 9, 109, 109'.

The hollow tubular portion 7, 107, 107' is configured to be driven into the sea bed to be located within an upper section of the bore hole. The hollow tubular portion 7, 7', 107, 107' is configured to provide support to the upper section of the bore hole, i.e. to prevent collapse of the surrounding soil into the bore hole, prior to and during subsequent drilling of the bore hole. The hollow tubular portion 7, 7', 107, 107' therefore helps to stabilise the soil, for example soft soil structures, adjacent the upper section of the bore hole.

The body member 2, 2', 102, 102' comprises a first side 10, 10', 110, 110' configured in use to be positioned facing the corresponding mooring line(s), and offshore installation, and an opposed second side 11, 11', 111, 111'. The first side 10, 10', 110, 110' of the body member 2, 2', 102, 102' comprises a connector 12, 12', 112, 112' for engaging, preferably releasably engaging, a termination of a mooring line termination for an offshore installation. It is to be understood that the body member 2, 102 may comprise any suitable number of connectors 12, 12', 112, 112' in any suitable location depending on the requirements for the base 1, 1', 101, 101'. By providing releasable engagement with the connector 12, 12', 112, 112' the base 1, 1', 101, 101' may be reused for connection to further mooring line terminations.

In the illustrated embodiment of FIGS. 1 to 5 and FIGS. 7A-B, the connector 12, 12' is of fixed orientation relative to the base member 2, 2' at a predetermined angle to align with an axis defined by the mooring line. The connector 12, 12' extends an at angle to the longitudinal axis of the guide channel 6, 6' and to the longitudinal axis of the bore hole. It is however to be understood, as shown in FIGS. 8 to 16, that the orientation of the one or more connectors 112, 112' may be independently adjustable, for example hinged or pivotally connected to the body member 102, 102', to align with an axis defined by the mooring line, depending on the requirements for the installation.

The connector 12, 12', 112, 112' is located adjacent the upper surface 4, 4', 104, 104' of the body member 2, 102, 102' such that the connector 12, 12', 112, 112' is located, in use, at a height about the sea bed to prevent the engaged mooring line from interacting with the seabed soils.

The seabed connection hub (SCH) 1, 1', 101 in the illustrated embodiments of FIGS. 1 to 5, 7A, 7B and FIGS. 8 to 13, further comprises one or more resistance members 13, 13', 113. As shown in the illustrated embodiments, the resistance members 13, 13', 113 are in the form of a plate located adjacent the second side 11, 11', 111 and extending outwardly from the body member 2, 2', 102. The resistance member 13, 13', 113 is configured to be received within the soil to increase resistance once embedded in the soil.

In the illustrated embodiments of FIGS. 1 to 5 and FIGS. 7A and 7B, the seabed connection hub (SCH) 1, 1' comprises three resistance members 13, 13' located adjacent the second side 11. 11' of the body member 2, 2'. It is however to be understood that the hub 1,1' may comprise any suitable numbers of resistance members 13, 13' at any suitable location on the body member 2, 2'. As shown in the illustrated embodiment of FIGS. 8 to 13, the hub 101 comprises a single resistance member 113 located adjacent the second side 111 of the body member 102. It is to be understood that the hub may comprise a pair of resistance members or more than three resistance members, depending on the particular requirements for the hub.

The resistance members 13, 13', 113 are steel, plate members each comprising an upper end 14, 14', 114 substantially aligned with an upper end 4, 4', 104 of the body member 2, 2', 102 and an opposed lower end 15, 15', 115 which is angular in shape to aid penetration into the sea bed.

The lower end 15, 15', 115 of the resistance members 13, 13', 113 extend from the lower surface 3, 3', 103 towards the upper surface 4, 4', 104 of the body member 2, 2', 102. The lower end 15, 15', 115 of the resistance members 13, 13', 113 extend beyond the lower surface 3, 3', 103 of the body member 2, 2', 102 such that the lower end 15, 15', 115 of the resistance members 13,13', 113 are embedded into the sea bed during installation and thus assist in stabilisation and ensuring verticality of the hub 1, 1', 101 when landed on seabed.

In the illustrated embodiments of FIGS. 1 to 5 and FIGS. 8 to 13, the body 16, 116 of each resistance member 13, 113 defines a plane extending substantially parallel to the longitudinal axis defined by the bore hole. It is however to be understood that the body 16, 116 of each resistance member 13, 113 may define a plane extending at an angle to the longitudinal axis defined by the bore hole. As shown in the illustrated embodiment of FIGS. 7A and 7B, the resistance member 13' may comprise a first portion 13*a*' which defines a plane extending substantially parallel to the longitudinal axis defined by the bore hole and a second portion 13*b*' which defines a plane extending at an angle to the longitudinal axis of the bore hole. The second portion 13*b*' in the illustrated embodiment can be seen to extend substantially perpendicular to the angle defined by the connector 12'. The portion 13*a*' of the resistance member 13' which defines a plane extending substantially parallel to the longitudinal axis aids penetration of the resistance member into the seabed. The portion 13*b*' of the resistance member 13' which defines a plane extending substantially perpendicular to the axis of the connector 12' helps to provide resistance to the lateral component of mooring lines loads.

With reference to FIGS. 1 to 5, each resistance member 13 extends substantially parallel to the other resistance members 13. The resistance members 13 are provided as a parallel array of resistance members 13. The resistance members 13 are spaced apart from each other and adjoined to each other by strengthening struts 17. It is however to be understood that the entire assembly may be constructed of steel plate or other suitable material. As shown in the illustrated embodiment of FIGS. 8 to 13, the resistance member 113 is secured to the body member 102 by struts 117. The struts 117 and resistance member 113 are formed by a continuous steel plate.

Figure 14:
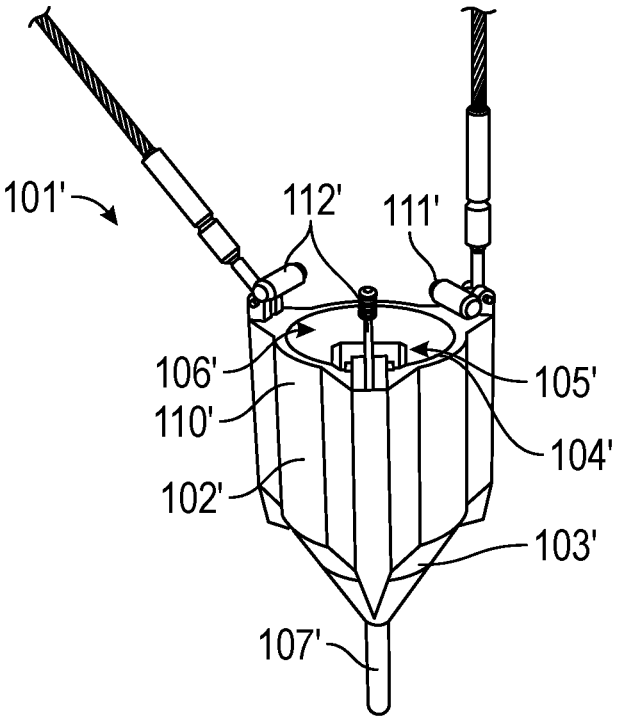
FIG. 14 is a schematic illustration of a perspective view from above of the seabed connection hub (SCH) of FIG. 13.
Figure 15:
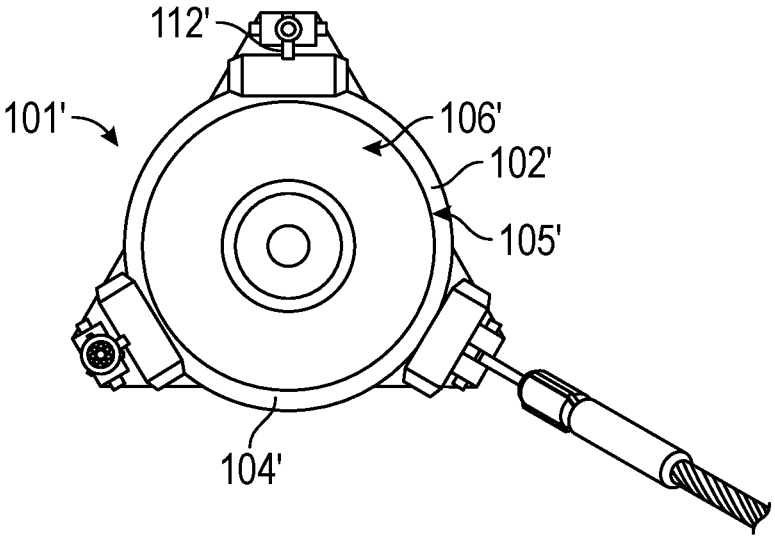
FIG. 15 is a schematic illustration of a view from above of a of the seabed connection hub (SCH) of FIG. 13.
Figure 16:
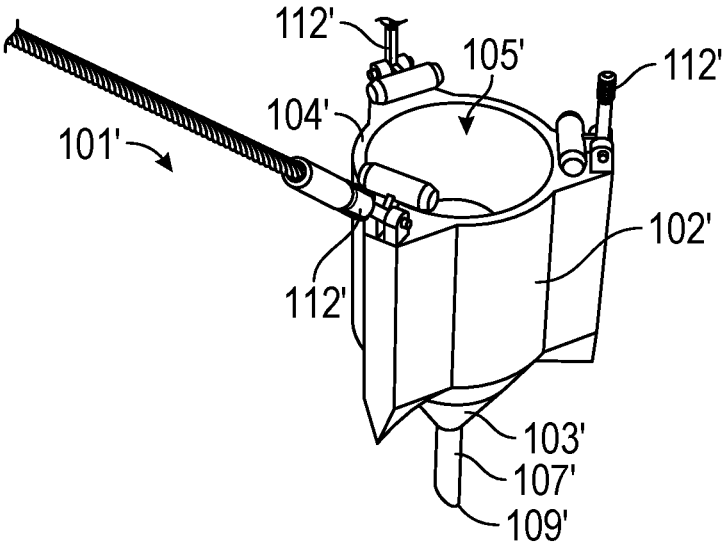
FIG. 16 is a schematic illustration of a perspective view from above of the body member portion of the seabed connection hub (SCH) of FIG. 13.
Figure 17A:
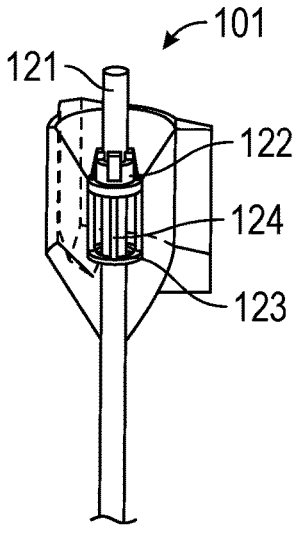
FIGS. 17A to 17D are schematic illustrations of the locking and tensioning mechanism of the seabed connection hub (SCH) according to one embodiment of the present invention.
Figure 17B:
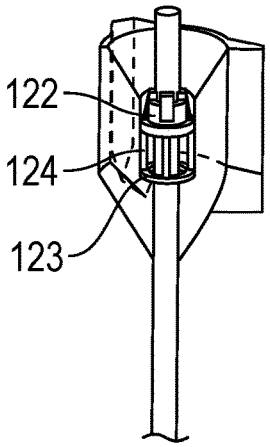
Figure 17C:
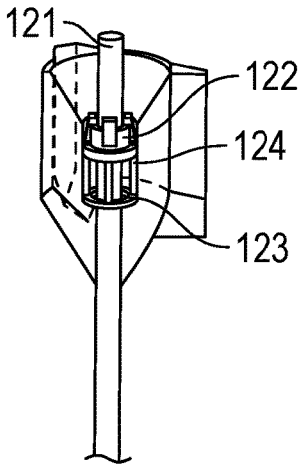
Figure 17D:
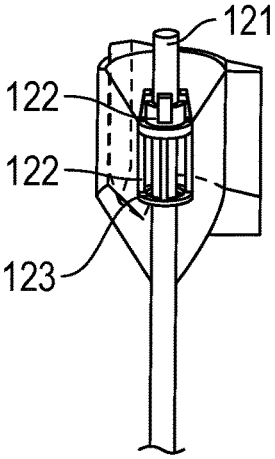

It is to be understood that the seabed connection hub 101' may not include resistance members as shown in FIGS. 14 to 16.

The seabed connection hub (SCH) 1, 1', 101, 101' further comprises a locking and tensioning mechanism 20, 120 as shown in FIGS. 6 and 17A-17D. The locking and tensioning mechanism 20, 120 is located within the guide channel 6, 6', 106, 106' of the hub 1, 1', 101, 101' to engage a elongate tensile member 21, 121 attached to an upper end of the deep set anchor (not shown) during installation. The locking and tensioning mechanism 20, 120 may be located at any suitable location within the guide channel 6, 106, 106'. The locking and tensioning mechanism 20, 120 comprises a plurality of circumferentially spaced apart grip portions 22, 122 mounted at a first end thereof. The locking and tensioning mechanism 20, 120 comprises an attachment feature 23, 123 located at a second end thereof and secured to the hub 1, 1', 101, 101'. The locking and tensioning mechanism 20, 120 comprises a hydraulic actuator 24, 124 extending between the grip portions 22, 122 and the attachment feature 23, 123.

In use, the seabed connection hub (SCH) 1, 1', 101, 101' as herein described is positioned on the sea bed such that the lower surface 3, 3', 103, 103' of the body member 2, 2', 102, 102' rests upon, and at least a portion of the lower surface 3, 3', 103, 103' of the body member 2, 2', 102, 102' penetrates, the sea bed.

The hollow tubular portion 7, 7', 107, 107' provides an opening through which a bore hole may be drilled or otherwise established. Once the bore hole is established, the hollow tubular portion 7, 7', 107, 107' supports and stabilises the soft soil structure adjacent the opening of the bore hole, preventing collapse of the surrounding soils. The conical lower surface 3, 3', 103, 103' of the body member 2, 2', 102, 102' and also, in some embodiments, the lower edge 15, 115, 115' of the resistance member(s) 13, 113, 113' are embedded into the sea bed.

A drilling assembly is inserted through the second opening 5, 5', 105, 105' provided by the upper surface 4, 4', 104, 104' of the base member 2, 2', 102, 102' into the guide channel 6, 6', 106, 106'. The drilling assembly is guided through the guide channel 6, 6', 106, 106' and the hollow tubular portion 7, 7', 107, 107' into the opening of the bore hole.

The drilling assembly is operated to drill the bore hole of required depth and the drilling assembly is subsequently removed from the bore hole and the hub 1, 101, 101'.

A deep set tensile anchor on a elongate tensile member 21, 121 is inserted through the second opening 5, 5', 105, 105' provided by the upper surface 4, 4', 104, 104' of the body member 2, 2', 102, 102' into the guide channel 6, 6', 106, 106'. The deep set tensile anchor is guided through the guide channel 6, 6', 106, 106' and the hollow tubular portion 7, 7', 107, 107' into the bore hole.

Figure 20:
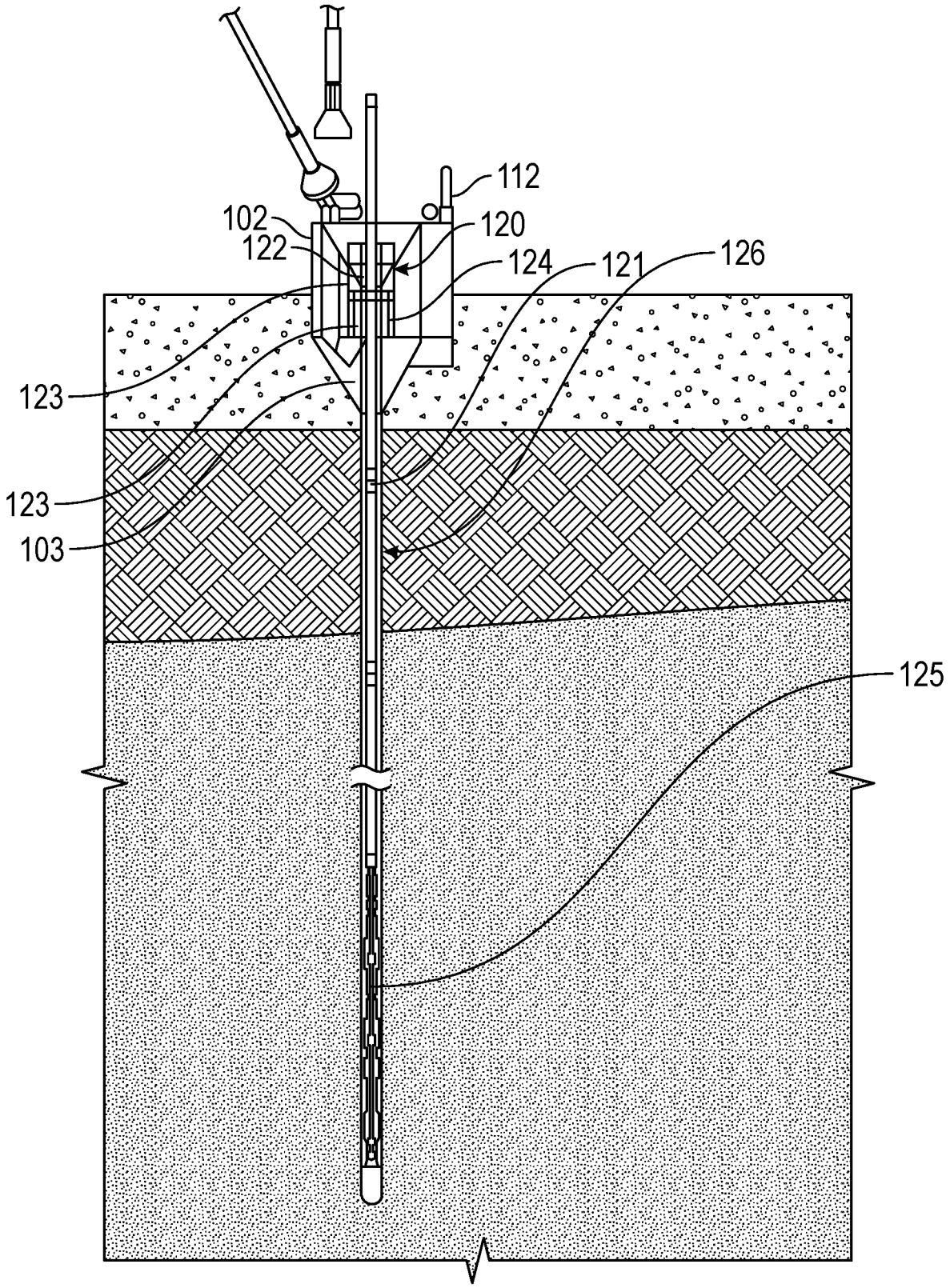
FIG. 20 is a schematic illustration of the seabed connection hub (SCH) according to one embodiment of the present invention in communication with a deep set tensile anchor.

The deep set tensile anchor 125 is inserted into the bore hole 126 (as shown in FIG. 20). During insertion the locking and tensioning mechanism 20, 120 (as shown in FIGS. 17A-D and 18) is operated such that the grip portions 22, 122 engage the elongate tensile member 21, 121 attached to the deep set tensile anchor at a predetermined located. The hydraulic actuator 24, 124 acts on the attachment feature 23, 123 which exerts a downward force onto the hub 1, 1', 101, 101' driving the hub 1, 1', 101, 101' into the seabed to provide a more secure seabed anchor for the vertical forces of the mooring line.

A mooring line for an offshore installation is connected to the connector 12, 12', 112, 112'.

Figure 18:
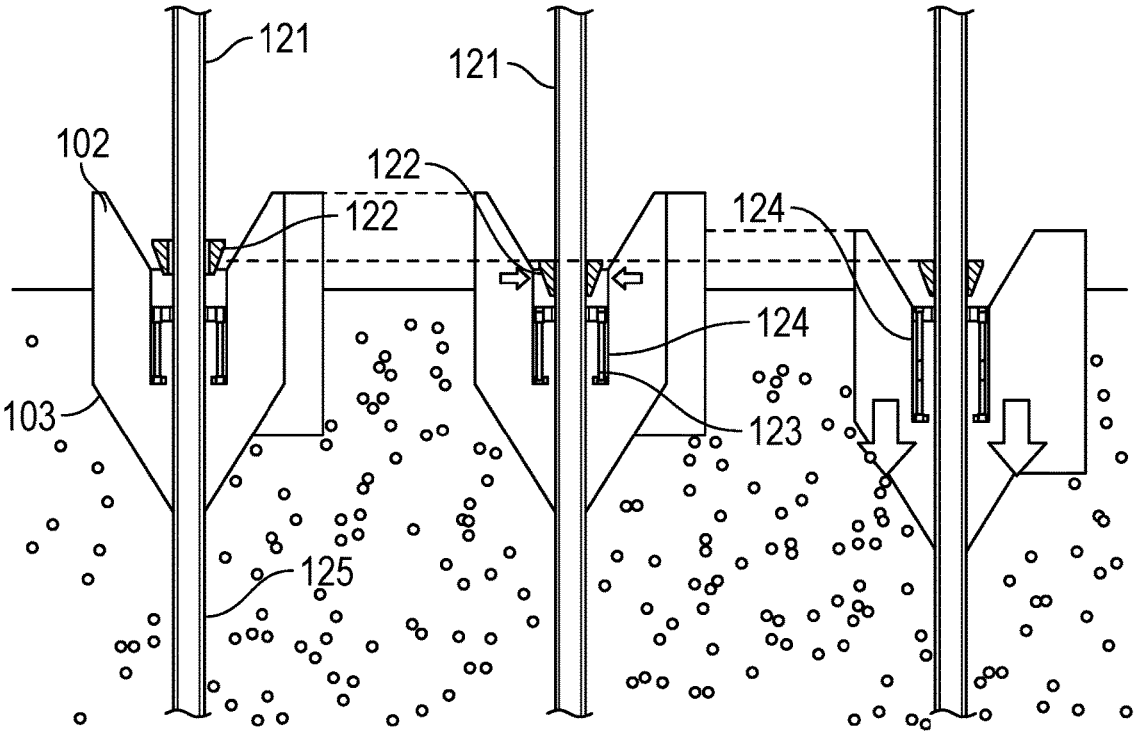
FIG. 18 is a schematic illustration of the locking and tensioning mechanism of the seabed connection hub (SCH) according to a further embodiment of the present invention.
Figure 19:
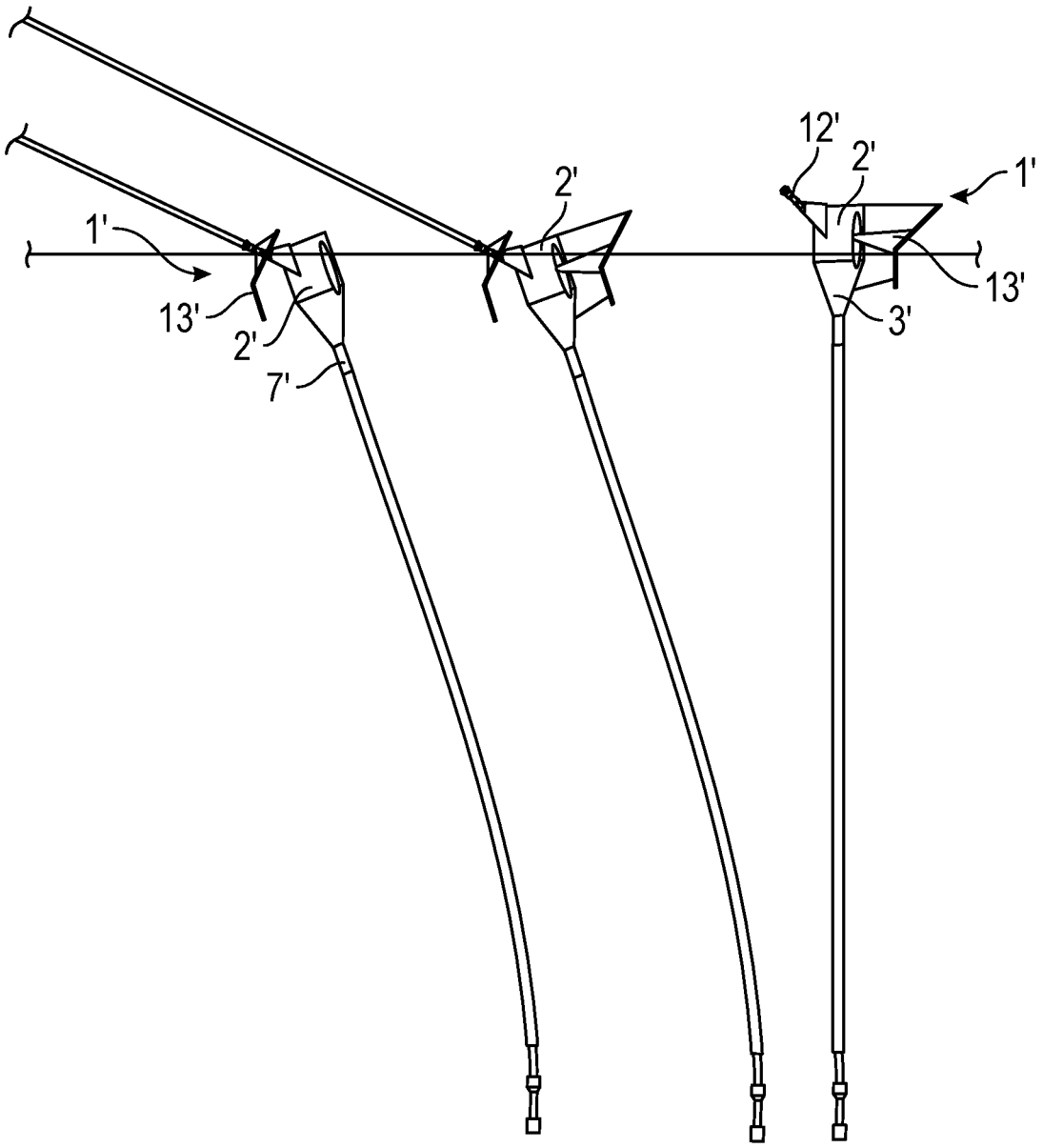
FIG. 19 is a schematic illustration of the seabed connection hub secured to the seabed and connected to a mooring line termination.

As shown in FIG. 18 the mooring line transmits tensile loading to the subsea connection hub 1' which provides a resistance point accommodating the change in direction of the tensile loading from vertical to lateral.

The resistance member(s) 13, 113 embedded in the soil, act to resist lateral forces from the mooring line as shown in FIG. 18. Furthermore, the conical lower surface 3, 3', 103, 103' of the body member 2, 2', 102, 102' is also embedded within the soil surrounding the bore hole opening and also transfers the lateral forces of the mooring line into the surrounding soil.

It is to be understood that the seabed connection hub (SCH) 1, 1', 101, 101' may comprise a lower surface having a different profile to the one illustrated in the attached Figures. For example, the lower surface may be angled or profiled to enable embedding within the soil surrounding the bore hole. The seabed connection hub (SCH) may comprise any suitable number of fixed, or adjustable (for example hinged or pivotable) connectors, at any suitable location on the body member. The seabed connection hub (SCH) 1, 1', 101, 101' may not include an elongate tensile member. The seabed connection hub (SCH) 1, 1', 101, 101' may comprise one or more engagement features for releasably engagement to cooperative engagement features on an elongate tensile member. The elongate tensile member may have any suitable profile and/or dimensions. The seabed connection hub (SCH) may comprise any suitable number of resistance members having any suitable shape and dimensions. The guide channel of the seabed connection hub (SCH) may extend through any suitable surfaces of the body member and is not limited to extending between the upper and lower surfaces thereof.

It is to be understood that the hub 1, 1', 101, 101' may be designed to be substantially or completely embedded to a depth in the seabed soils when tension is applied to the connected mooring line such that the transition base acts as an anchor or resistance device which is secondary to the deep set mooring pile and thereby reduces the tension applied at the deep set anchor pile.

The invention claimed is:

1. A seabed connection hub (SCH) for guiding a drilling assembly to drill a bore hole and subsequently guiding a deep set tensile anchor configured for deep installation into the borehole, the seabed connection hub (SCH) comprising a body member configured to act as a sea bed anchor, in which the body member comprises a lower surface configured in use to rest upon, and for at least a portion of the lower surface of the body member to penetrate, a sea bed, in which the body member comprises:

a guide channel extending therethrough to a first opening provided in the lower surface of the body member, in which the guide channel is configured to receive and guide a drilling assembly to produce a bore hole, and in which the guide channel is configured to receive and guide a deep set tensile anchor therethrough into the opening of the bore hole; and at least one connector for engaging one or more mooring line termination for an offshore installation, a hollow tubular portion in communication with the first opening provided on the lower surface thereof and extends outwardly therefrom to define a portion of the guide channel extending through the hollow tubular portion;

the lower surface of the body member is profiled to extend at an angle to a reference plane defined by the sea bed adjacent the bore hole, in which the lower surface of the body member comprises a tapered, conical portion, and the seabed connection hub (SCH) further comprises at least one resistance member extending outwardly from the body member and configured such that a portion of the at least one resistance member is received within the sea bed.

2. The seabed connection hub (SCH) according to claim 1, further comprising a locking and tensioning mechanism located within the guide channel to engage an elongate tensile member attached to an upper end of the deep set anchor, optionally in which the locking and tensioning mechanism comprises a slip type lock mechanism.

3. The seabed connection hub (SCH) according to claim 1, wherein the hollow tubular portion defines a portion of the guide channel having a longitudinal axis which is configured to extend, in use, substantially parallel to the longitudinal axis of the bore hole.

4. The seabed connection hub (SCH) according to claim 1, wherein the body member is composed of concrete.

5. The seabed connection hub (SCH) according to claim 1, wherein the hollow tubular portion is composed of steel.

6. The seabed connection hub (SCH) according to claim 1, wherein the hollow tubular portion is releasably engaged to the lower surface of the body member.

7. The seabed connection hub (SCH) according to claim 1, wherein the hollow tubular portion comprises a tapered, conical portion adjacent the lower surface of the body member.

8. The seabed connection hub (SCH) according to claim 1, wherein the body member comprises an upper surface defining a second opening for receiving a deep set tensile anchor therethrough, and in which the guide channel extends between the first and second openings of the body member, optionally in which the first and second openings are axially aligned along an axis which in use is configured to extend substantially parallel to the longitudinal axis of the bore hole.

9. The seabed connection hub (SCH) according to claim 8, wherein the second opening has greater dimensions than the first opening.

10. The seabed connection hub (SCH) according to claim 1, wherein the at least one connector are configured for releasable engagement to one or more mooring line termination for offshore installations.

11. The seabed connection hub (SCH) according to claim 1, in which the at least one connector is of fixed orientation relative to the base member and/or in which the at least one connector is a hinged or pivotally connected connector and/or in which the at least one connector is spaced apart from the lower surface of the base member and/or in which the at least one connector is located at or adjacent an upper surface of the base member.

12. The seabed connection hub (SCH) according to claim 1, wherein the body member comprises at least one connector located on a first side thereof for engaging one or more mooring line termination for offshore installations, and in which the body member further comprises at least one resistance member located at or adjacent a second opposed side of the body member.

13. The seabed connection hub (SCH) according to claim 1, wherein the at least one resistance member is a plate member, optionally, in which the resistance member comprises a upper end located adjacent an upper end of the base member, and an opposed lower end which is angular in shape to aid penetration into the sea bed.

14. A method of installing a deep set anchor using a seabed connection hub (SCH) according to claim 1, the method comprising:

positioning an seabed connection hub (SCH) as claimed in claim 1 such that the lower surface of the base member rests upon, and at least a portion of the lower surface of the base member penetrates, the sea bed, in which the first opening provided by the lower surface is aligned with an opening for a bore hole;

inserting the hollow tubular portion into the opening for a bore hole;

embedding at least a portion of at least one resistance member into the sea bed;

guiding a drilling assembly through the guide channel and first opening of the base member into the opening for a bore hole;

operating the drilling assembly to drill the bore hole;

inserting deep set tensile anchor on a elongate tensile member through the guide channel and first opening of the body member into the bore hole; and connecting one or more mooring line to the at least one connector, and subsequently tensioning to the one or more mooring line.

15. The method according to claim 14, further comprising operating a locking and tensioning mechanism located within the guide channel to engage the elongate tensile member attached to the deep set tensile anchor.

* * * * *